US007198020B1

(12) United States Patent
Beddick

(10) Patent No.: US 7,198,020 B1
(45) Date of Patent: Apr. 3, 2007

(54) LUBRICATION SYSTEMS AND METHODS FOR AN INTERNAL COMBUSTION ENGINE

(76) Inventor: Steven G Beddick, 304 Southfield Dr., Greensburg, PA (US) 16501

( * ) Notice: Subject to any disclaimer, the term of this patent is extended or adjusted under 35 U.S.C. 154(b) by 0 days.

(21) Appl. No.: 11/373,121

(22) Filed: Mar. 13, 2006

(51) Int. Cl.
*F01M 1/00* (2006.01)

(52) U.S. Cl. ..... 123/196 R; 184/15.2

(58) Field of Classification Search ..... 123/196 R, 123/73 AD, 196 AB, 65 R, 65 BA, 196 M, 123/559.1; 184/15.2, 18, 104.1
See application file for complete search history.

(56) References Cited

U.S. PATENT DOCUMENTS

| | | | | |
|---|---|---|---|---|
| 1,612,372 | A | | 12/1926 | Gussman |
| 1,940,132 | A | | 12/1933 | Kearns |
| 2,728,412 | A | | 12/1955 | Bolsius et al. |
| 2,800,119 | A | | 7/1957 | Schimdl |
| 2,983,334 | A | | 5/1961 | Dalrymple |
| 4,114,571 | A | | 9/1978 | Ruf |
| 4,162,662 | A | | 7/1979 | Melchior |
| 4,359,018 | A | | 11/1982 | Wade |
| 4,378,763 | A | | 4/1983 | Ishihama |
| 4,411,225 | A | | 10/1983 | Dell'Orto |
| 4,515,110 | A | | 5/1985 | Perry |
| 4,579,093 | A | | 4/1986 | Eanes |
| 4,622,933 | A | | 11/1986 | Fukuo et al. |
| 4,730,580 | A | * | 3/1988 | Matsushita ..... 123/196 R |
| 4,844,029 | A | | 7/1989 | Suzuki |
| 4,930,462 | A | | 6/1990 | Kamata |
| 4,969,430 | A | | 11/1990 | Masuda |
| 4,970,996 | A | | 11/1990 | Matsuo et al. |
| 4,989,555 | A | | 2/1991 | Matsuo et al. |
| 5,052,355 | A | | 10/1991 | Ito et al. |
| 5,183,134 | A | | 2/1993 | Kuc |
| 5,190,121 | A | | 3/1993 | Muzyk |
| 5,193,500 | A | | 3/1993 | Haft |
| 5,195,481 | A | | 3/1993 | Oyama et al. |
| 5,355,851 | A | | 10/1994 | Kamiya |
| 5,375,573 | A | * | 12/1994 | Bowman ..... 123/196 R |
| 5,501,190 | A | | 3/1996 | Okubo et al. |
| 5,511,523 | A | | 4/1996 | Masuda |
| 5,513,608 | A | | 5/1996 | Takashima et al. |
| 5,522,370 | A | | 6/1996 | Katoh et al. |
| 5,526,783 | A | | 6/1996 | Ito et al. |
| 5,537,959 | A | | 7/1996 | Ito |
| 5,542,387 | A | | 8/1996 | Okubo |
| 5,588,504 | A | | 12/1996 | Spiegel et al. |
| 5,617,822 | A | | 4/1997 | Masuda |
| 5,964,198 | A | | 10/1999 | Wu |
| 6,032,635 | A | | 3/2000 | Moorman et al. |

(Continued)

FOREIGN PATENT DOCUMENTS

| | | |
|---|---|---|
| DE | 42 05 663 A1 | 8/1993 |

*Primary Examiner*—Stephen K. Cronin
*Assistant Examiner*—Katrina Harris
(74) *Attorney, Agent, or Firm*—Oliff & Berridge, PLC

(57) ABSTRACT

A lubrication system for an internal combustion engine a lubricant source, a first lubricant passage that conducts lubricant from the lubricant source to a portion of the engine beneath the piston, and a second lubricant passage that conducts lubricant a space above the piston. The first lubricant passage may include a spray nozzle that sprays lubricant onto a crankshaft bearing and/or onto a wall of the cylinder. The second lubricant passage may conduct airborne lubricant from a crankcase of the engine to the space above the piston.

36 Claims, 3 Drawing Sheets

U.S. PATENT DOCUMENTS 6,098,587 A 8/2000 Malss et al.
6,216,651 B1 4/2001 Ishikawa et al.
6,394,860 B1 5/2002 Nanami et al.
6,640,768 B1 11/2003 Takashima et al.
2002/0017267 A1 2/2002 Nagai et al.

* cited by examiner

LUBRICATION SYSTEMS AND METHODS FOR AN INTERNAL COMBUSTION ENGINE

BACKGROUND 2-stroke engines have been used for a variety of mobile and stationary applications. They are advantageous for many applications due to the fact that they have few moving parts, are easy to maintain, and offer a superior weight-to-power ratio.

Conventionally, 2-stroke engines operate by drawing in a mixture of air, fuel and lubricant into the combustion chamber (i.e., the space formed by the top of a piston, the wall of a cylinder in which the piston travels, and a cylinder head that seals off the top end of the cylinder) as the piston approaches the bottom dead center position. This mixture is then compressed by the piston, causing the mixture to reach a pressure at which it can be ignited by an ignition source, such as a spark plug, when the piston is approximately at the top dead center position. The resulting explosion drives the piston downward in what is known as the power stroke. As the piston reaches bottom dead center, exhaust gases exit from the combustion chamber through a port in the cylinder wall or a poppet valve in the cylinder head, and a fresh mixture of air, fuel and lubricant is drawn into the combustion chamber for the next cycle.

Thus, the piston is driven through a power stroke with each revolution of the engine's crankshaft (in contrast to a 4-cycle engine, in which a power stroke occurs every other revolution of the crankshaft).

It is also known to directly inject the fuel into the combustion chamber, provide a separate air flow, and spray oil into the crankcase below the piston, as disclosed in, for example, U.S. Pat. No. 4,579,093 to Eanes.

SUMMARY

The above-described systems have disadvantages. For example, the first system, in which air, fuel and oil are mixed and then fed into the combustion chamber, uses liquid fuel to carry the lubricant, and therefore has not been compatible with alternative fuels such as propane, natural gas or the like. Additionally, it passes a lubricant-rich combustible blend to the combustion chamber. The lubricant in this mixture results in undesirable molecular and particulate emissions in the exhaust gas. Furthermore, many users find it troublesome to pre-mix the fuel and oil. The second system, in which the fuel, air and lubricant are introduced separately, does not apply the lubricant to the upper cylinder wall, piston rings and ring glands, and relies solely on an inherent lubricity of the fuel itself to mitigate the effects of heat and friction at these locations.

Embodiments of the present invention overcome these disadvantages by providing a lubrication system including a lubricant source, a first lubricant passage that conducts lubricant from the lubricant source to a portion of the engine beneath the piston, and a second lubricant passage that conducts lubricant into a space above the piston.

The first lubricant passage may include a spray nozzle that sprays lubricant onto a crankshaft bearing and/or onto a wall of the cylinder. The second lubricant passage may conduct airborne lubricant from the crankcase of the engine to the space above the piston.

These and other objects, advantages and/or features of the invention are described in or apparent from the following detailed description of exemplary embodiments.

BRIEF DESCRIPTION OF THE DRAWINGS

Exemplary embodiments are described below with reference to the drawings, in which like numerals represent like parts, and wherein.

DETAILED DESCRIPTION OF EMBODIMENTS

Exemplary embodiments of this invention provide two separate passages for conducting lubricant through an engine. The first passage may conduct lubricant from a lubricant source to a portion of the engine beneath the piston, and the second passage may conduct lubricant into a space above the piston.

Figure 1:
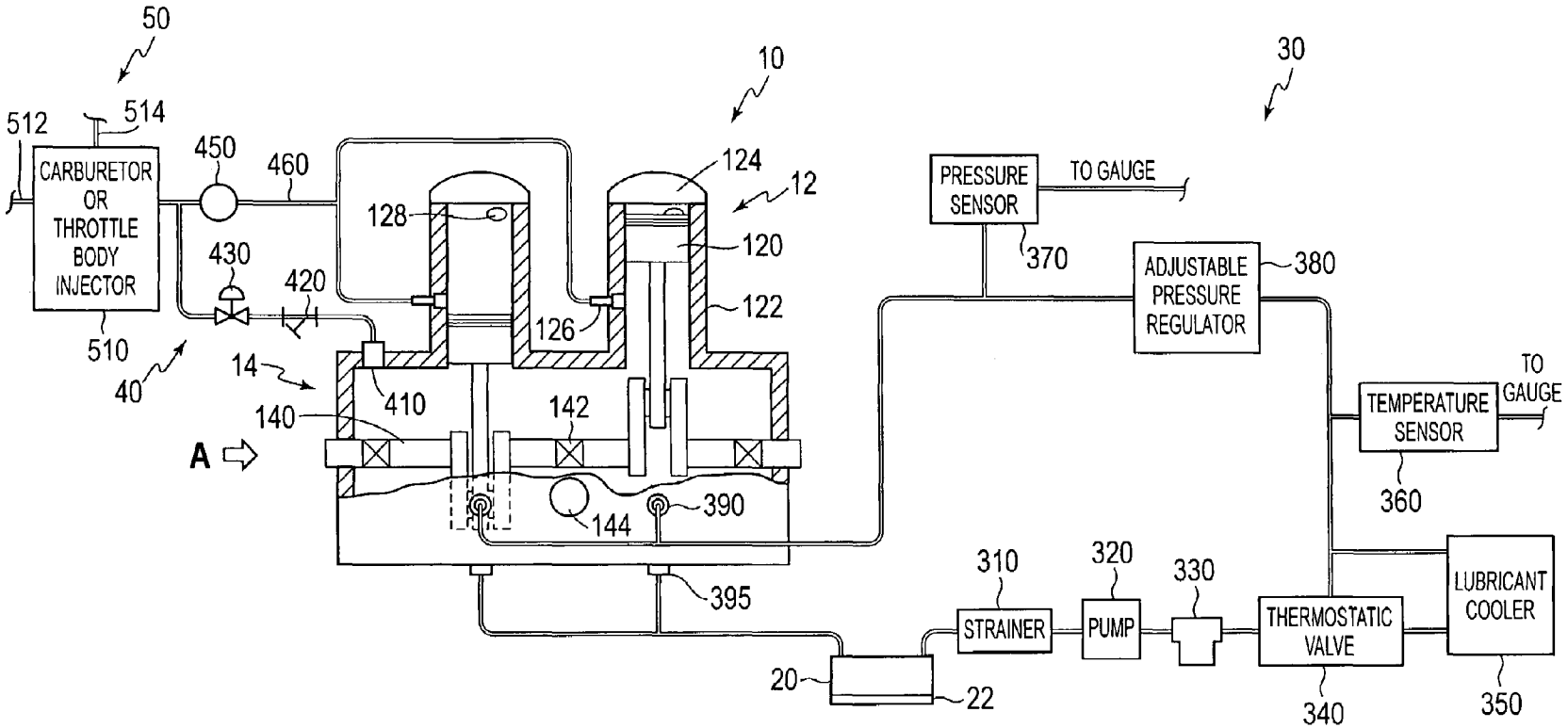
FIG. 1 illustrates a first embodiment of an internal combustion engine and a lubrication system for the internal combustion engine.

FIG. 1 illustrates a first embodiment of an internal combustion engine 10 and a lubrication system for the internal combustion engine 10.

In this embodiment, the engine 10 includes two cylinders 12, in communication with a crankcase 14. Other embodiments may have only a single cylinder, or more than two cylinders. The front wall of the crankcase 14 is partially cut away in FIG. 1, so that components within the crankcase 14 may more easily be viewed.

In known fashion, pistons 120 reciprocate within the cylinder walls 122. Cylinder heads 124 seal the upper ends of the cylinders 10. When a piston 120 is at the bottom of its stroke, known as the bottom-dead-center ("BDC") position, a mixture of fuel and air is admitted into the cylinder 12 through an intake port 126 that passes through the cylinder wall 122. The piston 120 then travels upward, compressing the mixture of fuel and air. This compressed mixture is then ignited by a spark plug or other ignition source (not shown) slightly after the piston has reached the top of its stroke, known as the top-dead-center ("TDC") position. The resulting explosion drives the piston 120 downward, forcefully driving a crankshaft 140, which rotates on bearings 142 within the crankcase 14. A new supply of fuel and air is subsequently introduced into the cylinder 12, and exhaust gases from the combustion of the fuel and air mixture previously supplied is exhausted through a valve 128, such as a poppet valve, or through an exhaust port (not shown) formed in the cylinder wall 122. The cycle is then repeated.

The crankcase 14 includes a crankcase breather 144, which allows air to pass into the crankcase 14. The crankcase breather 144 thus maintains the air pressure inside the crankcase 14 substantially equal to the surrounding atmosphere. A slight negative pressure may exist in the crankcase due to natural engine suction caused by, e.g., reciprocation of the pistons 120, or suction caused by a blower or the like, arranged as described in more detail below. The crankcase breather 144 may include a foam pad or the like to prevent lubricant from splashing out of the crankcase 14, and/or to prevent airborne lubricant from exiting through the crankcase breather 144.

A lubricant source 20, such as a tank, holds lubricant to be supplied to the engine 10. The lubricant may be mineral oil, a synthetic lubricant, a biological lubricant, or a blended lubricant. In short, any known or later developed lubricant suitable for engine lubrication may be used.

A heater 22 may be provided to pre-heat the lubricant. Pre-heating may be necessary or desirable to achieve a desired lubricant spray pattern, as discussed in more detail below. Although the heater 22 is attached to and/or positioned inside the lubricant source 20 in this embodiment, the heater may alternatively be separated from the lubricant source 20, preferably downstream from the lubricant source 20 and forming part of a lubricant passage 30, which is described in more detail below. The heater 22 may be powered by an electric power source (not shown).

The lubricant passage 30 routes lubricant from the lubricant source 20 to spray nozzles 390, which spray into the crankcase 14. The lubricant passage 30 includes a pump 320. The pump 320, which may be, for example, a positive displacement-type pump or a dynamic pump, can be mechanically, hydraulically, pneumatically or electrically driven by any known or later developed source (not shown), and generates a sufficient pressure in the lubricant to create a proper lubricant dispersion from the spray nozzles 390. The lubricant passage 30 may also include a strainer 310, preferably positioned upstream of the pump 320, for straining large particles of debris from the lubricant prior to entry of the lubricant into the pump 320. The lubricant passage 30 may also include a filter 330 for removing smaller particles of dirt or debris from the lubricant.

The lubricant passage 30 may also include a thermostatic valve 340 and a lubricant cooler 350. If the lubricant exceeds a certain temperature, the thermostatic valve 340 causes the lubricant to flow through the lubricant cooler 350. If the lubricant has not exceeded the predetermined temperature, the thermostatic valve 340 causes the lubricant to flow through the passage 30 without going through the lubricant cooler 350.

A temperature sensor 360 and/or a pressure sensor 370 may also be provided in the lubricant passage 30, and output to gauges (not shown) to allow an operator to monitor temperature and/or pressure of the lubricant.

A pressure regulator 380 preferably also is provided to reduce the lubricant pressure, if necessary, to achieve a desired spray pattern from the nozzles 390. The pressure regulator 380 may be adjustable, to allow an operator to adjust the lubricant pressure as desired. If the pressure regulator 380 is not an adjustable pressure regulator, then it may, for example, be selected to achieve a certain fixed lubricant pressure that has been empirically determined in advance, i.e., determined by experimentation.

Alternatively, the pressure regulator 380 may be dynamically adjustable based on one or more variables. For example, the pressure regulator 380 may receive input from the temperature sensor 360 (or a different temperature sensor), and adjust the pressure to achieve the desired spray pattern despite variations in viscosity and temperature.

The pressure sensor 370 preferably is located in a portion of the lubricant passage 30 between the pressure regulator 380 and the nozzles 390. With this configuration, the pressure regulator 380 indicates the pressure at the nozzles 390.

In FIG. 1, the pressure regulator 380 is depicted as having a single inlet and a single outlet. With this configuration, the pressure regulator 380 may create a back pressure on the pump 320 when the pressure regulator 380 reduces lubricant pressure. Alternatively, the pressure regulator 380 may be configured to have a second outlet that returns lubricant directly to the lubricant source 20. With this configuration, the pressure regulator 380 shunts excess lubricant directly to the lubricant source 20, thereby avoiding creation of a large back pressure on the pump 320.

Examples of devices usable as the strainer 310, the pump 320, the filter 330, the thermostatic valve 340, lubricant cooler 350, temperature sensor 360, pressure sensor 370 and pressure regulator 380 are known in the art; therefore, further details are not described here.

After lubricant is sprayed into the crankcase 14 by spray nozzles 390, part of the lubricant will lubricate a portion of the engine beneath the pistons 120, such as the crankshaft 140, bearings 142, piston arms (not labeled), wrist pins (not labeled) that connect the piston arms to the pistons 120, etc. Another portion of the lubricant will become airborne, resulting in lubricant-misted air being present in the crankcase 14. Lubricant that drips off of the engine components flows to drains 395 and returns to the lubricant source 20. Airborne lubricant from the crankcase 14 is conducted to a space above the pistons 120, as described in more detail below.

Figure 3:
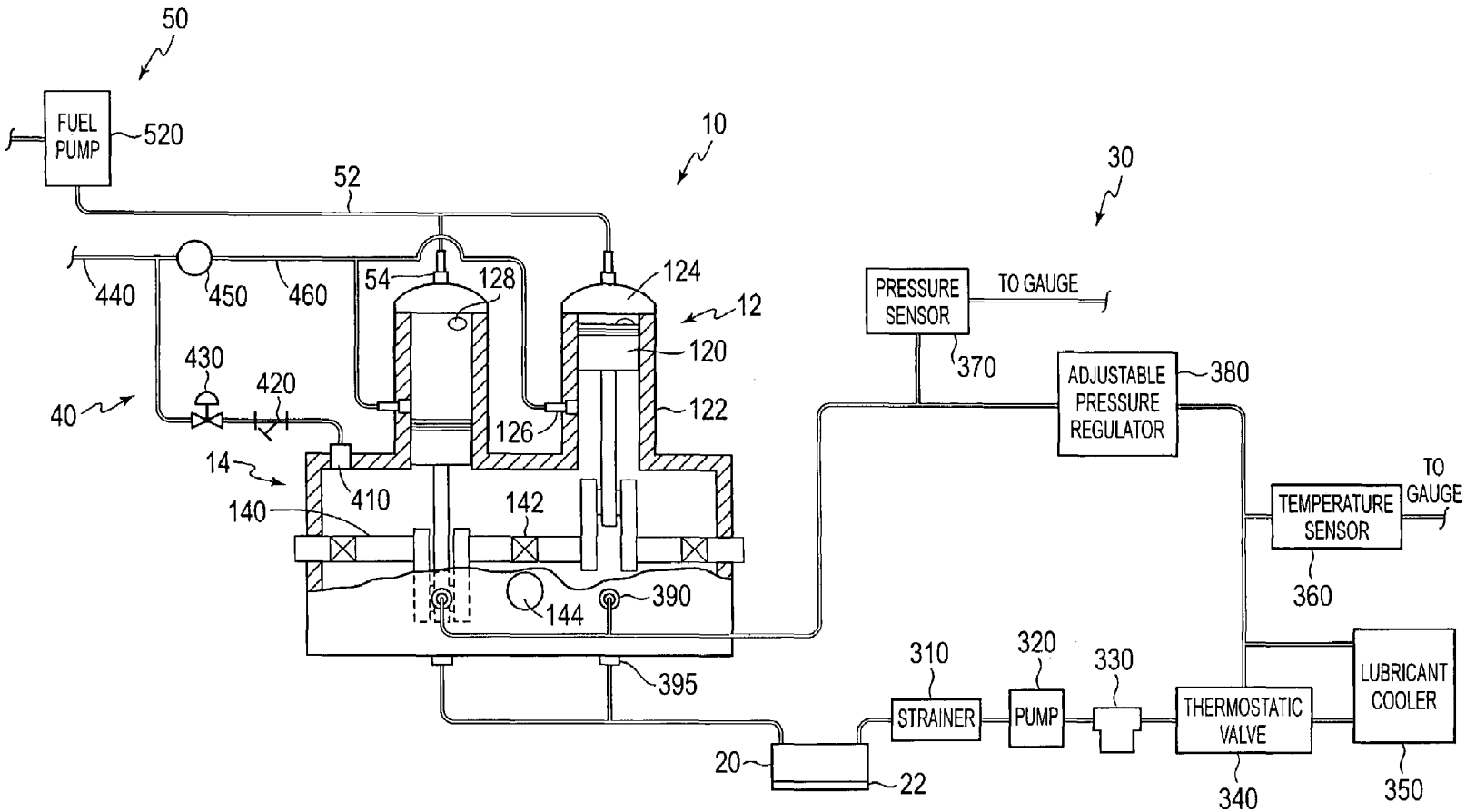
FIG. 3 illustrates a second embodiment of an internal combustion engine and a lubrication system for the internal combustion engine.

As an alternative to the arrangement of the lubricant source 20 and the lubricant passage 30 depicted in FIGS. 1 and 3, the lubricant source 20 and lubricant passage 30 may be arranged within the crankcase 14. In this case, of course, lubricant would not drain from the crankcase 14 in operation, because the bottom of the crankcase 14 would serve as the lubricant source. The heater 22, if used, could be positioned within the crankcase 14, in contact with the lubricant, and would not need to be part of the lubricant passage 30.

A second lubricant passage 40 conducts airborne lubricant from the crankcase 14 to the cylinders 12, into a space above the pistons 120. The lubricant passage 40 includes a port 410 that passes through a wall of the crankcase 14, and may also include a lubricant mist reducer 420. The lubricant mist reducer 420 reduces the amount of airborne lubricant in the lubricant-misted air taken from the crankcase 14. The lubricant mist reducer 420 may be constituted by, for example, a foam pad through which lubricant-misted air flows.

The lubricant passage 40 may also include a control valve 430. The control valve 430 may be used to regulate the amount of lubricant-misted air that flows into the cylinders 12. A known example of such a control valve is a crankcase atmosphere induction manifold ("CAIM") valve. The control valve 430 may be manually set, or may be automatically controlled based on input from one or more sensors, such as an air pressure sensor, an engine speed sensor, or an engine load sensor.

A positive air pressure generation device 450, such as a blower or turbocharger, may also be provided in the lubricant passage 40. In this embodiment, the positive air pressure generation device 450 is located in a portion of the lubricant passage 40 that is an intake air manifold 460, which also conducts a mixture of fuel and air obtained from a fuel supply device 50 into the cylinders 12. The positive air pressure generation device 450 forces the mixture of (1) lubricant-misted air from the crankcase 14 and (2) air and fuel obtained from the fuel supply device 50, into the cylinders 12.

Alternatively, instead of a portion of the lubricant passage 40 including the intake air manifold 460, and thus being common with a portion of the gaseous fuel and air intake passage, the lubricant passage 40 may feed directly into the cylinders 12 via a dedicated opening (not shown). In this case, the positive air pressure generation device 450 would not affect the flow of gaseous fuel and air. If desired, a separate positive air pressure generation device 450 could be provided in the gaseous fuel and air intake passage.

The fuel supply device 50 is, in this embodiment, a device that combines air and liquid fuel into a gaseous mixture of air and fuel. For example, the fuel supply device 50 may be a carburetor or throttle body injector 510 that intakes liquid fuel from a liquid fuel source (not shown) via a fuel line 512, and intakes air via an air intake passage 514, entrains fuel in the air in a known (or later developed) manner, and outputs a gaseous mixture of fuel and air into the passage 40.

Alternatively, the fuel supply device 50 may take in gaseous fuel, such as natural gas, propane, hydrogen or the like, and meter it with air through a known or later developed mixer or fumigator.

Figure 2:
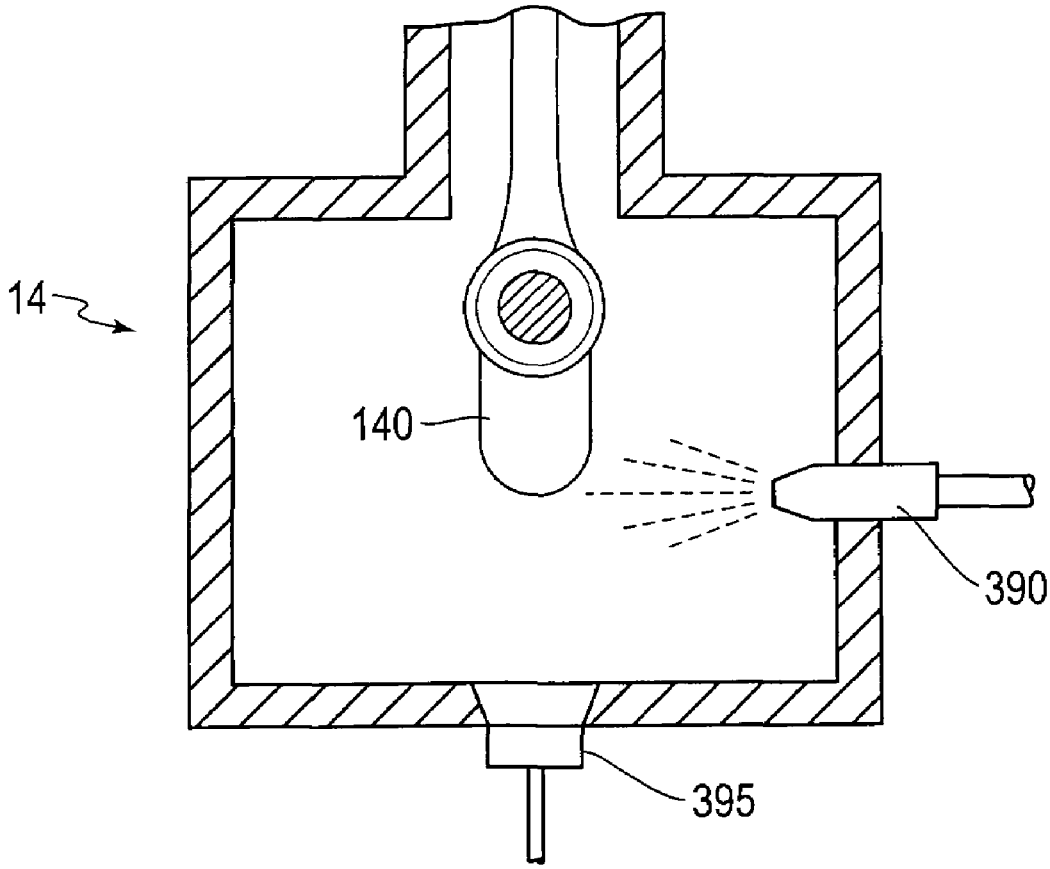
FIG. 2 is view from within the crankcase of the engine of FIG. 1, in the direction of arrow A of FIG. 1.

FIG. 2 shows a side view of a nozzle 390 and a drain 395, as viewed from within the crankcase 14 in the direction of arrow A of FIG. 1. In FIG. 2, the nozzle 390 is about level with the center of rotation of the crankshaft 140; however, it will be appreciated that the location and angle of the nozzle can be selected as appropriate to achieve a desired spray pattern, and a desired location of the spray, to achieve the best lubrication results. Other variables that affect the spray pattern are nozzle size and the internal shape of the nozzle. An appropriate nozzle location, nozzle angle, nozzle size and internal nozzle shape may be determined empirically for a given engine configuration.

In the depicted embodiments, one spray nozzle 390 is provided for each piston 120. However, the number of spray nozzles may be greater or fewer than the number of pistons.

FIG. 3 illustrates another embodiment of the invention. In this embodiment, rather than using a carburetor or a fumigator or the like as the fuel supply device 50, a fuel pump 520 is used as the fuel supply device 50. The fuel pump 520 supplies fuel directly to the cylinders 122 via a fuel line 52 and fuel injectors 54. The fuel injectors may be of a known or later-developed type.

Additionally, in this embodiment, air is taken in separately from an external air intake passage 440. Thus, the positive air pressure generation device 450, when used, forces a mixture of (1) lubricant-misted air from the crankcase 14 and (2) air obtained from the air intake passage 440, into the cylinders 12.

As with the first embodiment discussed above, this embodiment may be modified such that the lubricant passage 40 feeds directly into the cylinders 12 via a dedicated opening (not shown).

In the above-described embodiments, various details known in the art have not been described. For example, an air filter and/or fuel filter may be provided upstream of the engine 10, to help ensure that fuel-borne or airborne debris does not enter the engine 10. As another example, the engine 10 includes a timing system for timing the ignition of the compressed mixture of gas and fuel. Those skilled in the art will understand how to implement such features.

The example of a spark plug was given, but the ignition may be achieved with any type of ignition, such as spark, plasma, catalytic or compression.

The lubrication system may be an integral complement of a new engine design, or may be retrofitted on an existing engine design. As described above, instead of a using a poppet valve 128 for exhaust, the exhaust from the cylinders 122 may exit through an exhaust port formed in a side wall of the cylinders 122. More specifically, if the pressure of the incoming mixture of fuel and air is sufficient to overcome the pressure of the exhaust stream, an exhaust port in the side of the cylinder wall may be used. If the pressure of the incoming mixture of gas and air is not of sufficient pressure to overcome the pressure of the exhaust stream, a valve such as the poppet valve 128 should be used to prevent backflow of exhaust into the intake system. Other examples of valves that may be used are reed valves and rotary valves.

The depicted engine 10 is a 2-cycle engine, but various aspects of the invention are also applicable to 4-cycle engines. Those skilled in the art will appreciate and be able to implement any necessary structural changes to convert the depicted 2-cycle engine to a 4-cycle engine.

In the embodiments described above, lubricant can be supplied to a portion of the engine beneath the pistons, and also to a space above the pistons. Therefore, not only can the rotating components and bearing components of the engine be lubricated, but the cylinder walls and rings can also be lubricated. Additionally, lubrication rates for (1) the rotating components and bearing components below the pistons and (2) the cylinder walls and rings can be controlled separately.

Advantages of these features include reduced engine emissions and increased component life. Exemplary embodiments of the invention are also applicable to both gaseous and liquid fuels, to any of the ignition methods discussed above, and to any aspiration method, such as natural, supercharged, or turbocharged. The invention is also applicable to all combustion cycles, such as Otto, Diesel and Miller, and to any type of fuel system, such as fumigation, carburetion, injection, or direct injection. Additionally, as discussed above, exemplary embodiments of the invention are applicable with many different types of lubricant, such as mineral oils, synthetic lubricants, biological lubricants, or blended lubricants.

While the invention has been described in conjunction with specific embodiments, these embodiments should be viewed as illustrative and not limiting. Various changes, substitutes, improvements or the like are possible within the spirit and scope of the invention.

What is claimed is:

1. A lubrication system for an internal combustion engine including a piston that travels in a cylinder, the lubrication system comprising:

a lubricant source;

a first lubricant passage that conducts lubricant from the lubricant source to a portion of the engine beneath the piston; and a second lubricant passage that conducts lubricant from a crankcase of the engine to the space above the piston.

2. The lubrication system according to claim 1, wherein the first lubricant passage includes a spray nozzle that sprays lubricant onto a crankshaft bearing and/or onto a wall of the cylinder.

3. The lubrication system according to claim 1, wherein the second lubricant passage includes a positive air pressure generation device.

4. The lubrication system according to claim 1, wherein the second lubricant passage includes a control valve that controls the rate of flow of airborne lubricant to the space above the piston.

5. The lubrication system according to claim 1, wherein a portion of the second lubricant passage is common with a portion of a gaseous fuel and air intake passage that conducts gaseous fuel and air from a gaseous fuel source to the space above the piston.

6. The lubrication system according to claim 1, wherein the second lubricant passage is common only with an external air intake passage and is entirely separate from a fuel intake passage of the engine.

7. The lubrication system according to claim 1, wherein the engine is a 2-cycle engine.

8. An internal combustion engine, comprising:

a piston that travels in a cylinder; and the lubrication system according to claim 1.

9. A lubrication system for an internal combustion engine including a piston that travels in a cylinder, the lubrication system comprising:

a lubricant source;

first lubrication means for conducting lubricant from the lubricant source to a portion of the engine beneath the piston; and second lubrication means for conducting lubricant from a crankcase of the engine into a space above the piston.

10. The lubrication system according to claim 9, wherein the engine is a 2-cycle engine.

11. An internal combustion engine, comprising:

a piston that travels in a cylinder; and the lubrication system according to claim 9.

12. The lubrication system according to claim 9, further comprising air intake means for taking in air, other than air from the crankcase of the engine, for combustion.

13. A method of lubricating an internal combustion engine including a piston that travels in a cylinder, the method comprising:

using a first lubricant passage to conduct lubricant from a lubricant source to a portion of the engine beneath the piston; and using a second lubricant passage to conduct lubricant from a crankcase of the engine into a space above the piston.

14. The method according to claim 13, wherein the first lubricant passage includes a spray nozzle that sprays lubricant onto a crankshaft bearing and/or onto a wall of the cylinder.

15. The method according to claim 13, wherein the second lubricant passage includes a positive air pressure generation device.

16. The method according to claim 13, wherein the second lubricant passage includes a control valve that controls the rate of flow of airborne lubricant to the space above the piston.

17. The method according to claim 13, wherein a portion of the second lubricant passage is common with a portion of a gaseous fuel and air intake passage that conducts gaseous fuel and air from a gaseous fuel source to the space above the piston.

18. The method according to claim 13, wherein the second lubricant passage is common only with an external air intake passage and is entirely separate from a fuel intake passage of the engine.

19. The method according to claim 13, wherein the engine is a 2-cycle engine.

20. The lubrication system according to claim 1, further comprising an air intake system that takes in air, other than air from the crankcase of the engine, for combustion.

21. The method according to claim 13, further comprising taking in air, other than air from the crankcase of the engine, for combustion.

22. A lubrication system for an internal combustion engine including a piston that travels in a cylinder, the lubrication system comprising:

a lubricant source;

a first lubricant passage that conducts lubricant from the lubricant source to a portion of the engine beneath the piston; and a second lubricant passage that conducts lubricant to the space above the piston;

wherein a portion of the second lubricant passage is common with a portion of a gaseous fuel and air intake passage that conducts gaseous fuel and air from a gaseous fuel source to the space above the piston.

23. An internal combustion engine, comprising:

a piston that travels in a cylinder; and the lubrication system according to claim 22.

24. A lubrication system for an internal combustion engine including a piston that travels in a cylinder, the lubrication system comprising:

a lubricant source;

first lubrication means for conducting lubricant from the lubricant source to a portion of the engine beneath the piston; and second lubrication means for conducting lubricant into a space above the piston;

wherein a portion of the second lubricant passage is common with a portion of a gaseous fuel and air intake passage that conducts gaseous fuel and air from a gaseous fuel source to the space above the piston.

25. An internal combustion engine, comprising:

a piston that travels in a cylinder; and the lubrication system according to claim 24.

26. A method of lubricating an internal combustion engine including a piston that travels in a cylinder, the method comprising:

using a first lubricant passage to conduct lubricant from a lubricant source to a portion of the engine beneath the piston; and using a second lubricant passage to conduct lubricant into a space above the piston;

wherein a portion of the second lubricant passage is common with a portion of a gaseous fuel and air intake passage that conducts gaseous fuel and air from a gaseous fuel source to the space above the piston.

27. A lubrication system for an internal combustion engine including a piston that travels in a cylinder, the lubrication system comprising:

a lubricant source;

a first lubricant passage that conducts lubricant from the lubricant source to a portion of the engine beneath the piston; and a second lubricant passage that conducts lubricant to the space above the piston;

wherein the second lubricant passage is common only with an external air intake passage and is entirely separate from a fuel intake passage of the engine.

28. An internal combustion engine, comprising:

a piston that travels in a cylinder; and the lubrication system according to claim 27.

29. A lubrication system for an internal combustion engine including a piston that travels in a cylinder, the lubrication system comprising:

a lubricant source;

first lubrication means for conducting lubricant from the lubricant source to a portion of the engine beneath the piston; and second lubrication means for conducting lubricant into a space above the piston;

wherein the second lubricant passage is common only with an external air intake passage and is entirely separate from a fuel intake passage of the engine.

30. An internal combustion engine, comprising:

a piston that travels in a cylinder; and the lubrication system according to claim 29.

31. A method of lubricating an internal combustion engine including a piston that travels in a cylinder, the method comprising:

using a first lubricant passage to conduct lubricant from a lubricant source to a portion of the engine beneath the piston; and using a second lubricant passage to conduct lubricant into a space above the piston;

wherein the second lubricant passage is common only with an external air intake passage and is entirely separate from a fuel intake passage of the engine.

32. A lubrication system for an internal combustion engine including a piston that travels in a cylinder, the lubrication system comprising:

a lubricant source;

a first lubricant passage that conducts lubricant from the lubricant source to a portion of the engine beneath the piston;

a second lubricant passage that conducts lubricant to the space above the piston; and a recirculation system that recirculates lubricant from the portion of the engine beneath the piston.

33. An internal combustion engine, comprising:

a piston that travels in a cylinder; and the lubrication system according to claim 32.

34. A lubrication system for an internal combustion engine including a piston that travels in a cylinder, the lubrication system comprising:

a lubricant source;

first lubrication means for conducting lubricant from the lubricant source to a portion of the engine beneath the piston;

second lubrication means for conducting lubricant into a space above the piston; and recirculation means for recirculating lubricant from the portion of the engine beneath the piston.

35. An internal combustion engine, comprising:

a piston that travels in a cylinder; and the lubrication system according to claim 34.

36. A method of lubricating an internal combustion engine including a piston that travels in a cylinder, the method comprising:

using a first lubricant passage to conduct lubricant from a lubricant source to a portion of the engine beneath the piston;

using a second lubricant passage to conduct lubricant into a space above the piston; and recirculating lubricant from the portion of the engine beneath the piston.

* * * * *